United States Patent [19]

Reynolds

[11] 4,003,623

[45] Jan. 18, 1977

[54] WIRE SECURING MEMBER WITH VARYING SERRATIONS

[75] Inventor: Charles Edward Reynolds, Mechanicsburg, Pa.

[73] Assignee: AMP Incorporated, Harrisburg, Pa.

[22] Filed: Sept. 12, 1975

[21] Appl. No.: 665,894

Related U.S. Application Data

[63] Continuation-in-part of Ser. No. 505,423, Sept. 12, 1974, abandoned.

[52] U.S. Cl. ..... 339/97 C

[51] Int. Cl.[2] ..... H01R 11/20

[58] Field of Search ..... 339/95, 97, 98, 223, 339/276; 174/84 C, 90 R, 94 R

[56] References Cited

UNITED STATES PATENTS

| | | | |
|---|---|---|---|
| 3,355,698 | 11/1967 | Keller | 339/97 C |
| 3,735,331 | 5/1973 | O'Donnell et al. | 339/97 C |
| 3,812,448 | 5/1974 | Haitmanek | 339/97 C |
| 3,852,702 | 12/1974 | Dowling | 339/223 R |

*Primary Examiner*—Joseph H. McGlynn
*Attorney, Agent, or Firm*—William J. Keating; Donald W. Phillion

[57] ABSTRACT

A serrated wire securing member for use such as a terminal or splice for making connection to at least one wire includes a plurality of side-by-side ridges along an axis perpendicular to the axis of a piece of metal crimped about and encircling the wire. The ridges have floors in the interspaces therebetween of progressively decreasing depth from one end thereof, and have trapezoidal walls, the walls facing in one direction being of essentially one angle, and the walls facing in the other direction being of progressively increasing angle. The varying floor depth and wall angles together and individually promote the flow of the wire conductor material into more uniform contact with the terminal material to form better physical and electrical connection therebetween.

20 Claims, 4 Drawing Figures

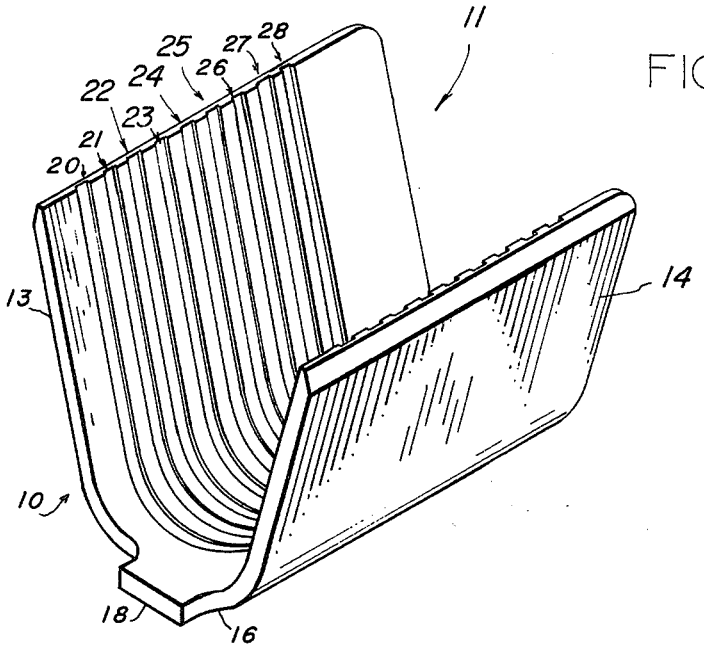
FIG. 1
FIG. 2
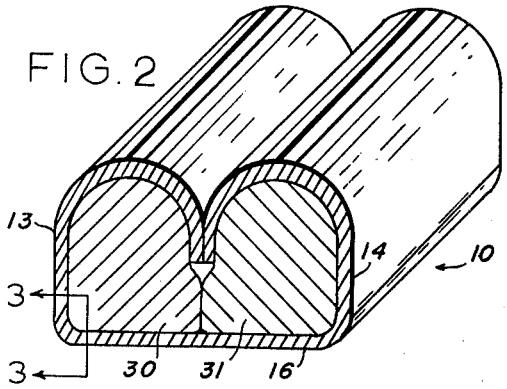
FIG. 3
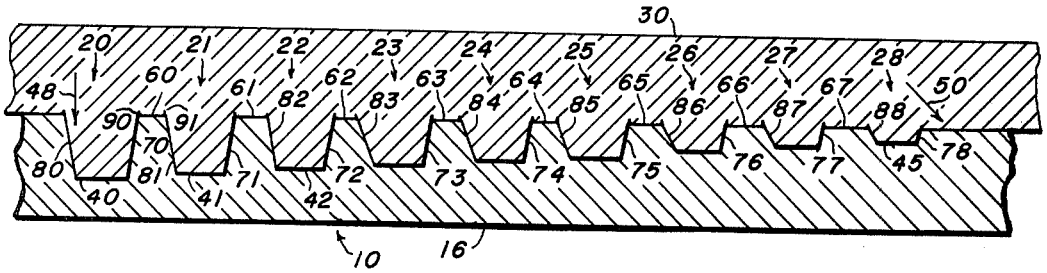

WIRE SECURING MEMBER WITH VARYING SERRATIONS

BACKGROUND OF THE INVENTION

1. Field of the Invention

This invention relates to improvements in wire securing members, and more particularly, to improvements in serrated type wire securing members to present enhanced physical and electrical characteristics.

2. Description of the Prior Art

In making electrical connections between two or more wires, a "splice" apparatus is often employed. Also, in establishing a connection between one or more wires, and, for example, a terminal post or other connection to electrical circuitry, a so called "terminal" is employed. Such terminals typically employ a planar section which is formed by a crimping tool to encircle the wire or wires to be connected. Upon further crimping pressure by the crimping tool, the wires are firmly secured in a barrel portion formed by the bent planar member about the wires. A tongue portion, often of donut shape, extends cutwardly from the planar member to be attached to a bolt or terminal post or other circuitry means. The splice, on the other hand, is of similar construction to the terminal, except that the donut or circuitry connection portion is generally omitted. Usually, two or more wires are located adjacent the planar member, and the planar member is bent into a barrel shape and crimped by a similar crimping tool to secure the wires therein.

It has been known that the inclusion of multiple serrations or ridges upon the planar portion of such splice or terminal which is crimped to form the wire securing barrel greatly enhances the physical and electrical connections made to the wire or wires desired to be connected to the terminal or splice. In operation, because of the serrations, generally the insulation from the wires to be connected is not required to be removed. As the planar portion is crimped about the wire, the protrusions or ridges of the serrations actually penetrate the insulation, tearing it from the conductor of the wire. Upon further application of the crimping force, the metal or conductor material of the wire is forced or squeezed into the grooves or serrations between the ridges.

In forming a splice connection between two or more wires, typically the wires to be spliced are placed within the splice apparatus, and are blocked at their free ends by a shear or cutting blade which trims off the excess wire. The planar section of the splice is then mechanically crimped into a barrel form around the wires, and a crimping pressure applied to force the serrations through the insulation and the conductor material into the serrations, as above mentioned. Because of the blocked end, however, a transverse force which increases with distance from the blocked end exists within the wire material along the length of the wire away from the blocked end by virtue of the tremendous crimping forces applied. This transverse force causes the conductor material of the wire to actually move in a direction away from the blocked end. This, in turn, exerts a tremendous force upon the walls of the ridges defining the serrations, and in many cases, actually bends the serration walls over, especially in the ridges farthest away from the blocked end.

Additionally, because of the transverse direction of the flow of conductor material, the conductor material is not effectively forced to the floors of the serrations away from the blocked end. This results in relatively poor electrical connection at these serrations.

Another disadvantage of the splices of the prior art is that ordinarily only a very narrow range of wire sizes can be accommodated by a particular size of splice member. For example, if too small a wire is attempted to be crimped within a splice member, the ridges or ribs of the serration can actually cut completely through the conductor as well as the insulation thereof, destroying an electrical connection which might otherwise be made. On the other hand, if too large a wire were attempted to be connected to the splice member, the ridges of the serrations in some cases may not penetrate through the thick insulation layer of the wire.

Since the terminal connectors embody as a part thereof a member or portion similar to the splice member above described, which functions in essentially the same manner, except that it can be used with one or more wires, the terminal members of the prior art suffer the same disadvantages of the splice members. As used hereinafter, it will be understood tht the word "terminal" includes both terminal members and slice members as above described.

SUMMARY OF THE INVENTION

In light of the above, it is, therefore, an object of the invention to present a wire securing member for use such as a wire terminal or splice having a securing barrel about the wire or wires to be secured which forms better physical and electrical connections to the contained wire than those heretofore advanced.

It is another object of the invention to present a wire securing member which can accommodate a relatively wide range of wire sizes.

It is still another object of the invention to present a wire securing member which can simultaneously accommodate wires of different diameters in the same securing barrel.

It is yet another object of the invention to present a wire securing member which does not cut through a wire of smaller than usual size in an essential location upon crimping the barrel thereof around the wire.

It is still another object of the invention to present a wire securing member which as improved tensile values between the wire and barrel.

It is yet another object of the invention to present a wire securing member in which upon crimping the serrations thereof become more uniformly filled with the wire conductor, to enhance stable electrical performance.

It is still yet another object of the invention to present a wire securing member having serrations which penetrate an insulation layer of a received wire more satisfactorily than heretofore achievable.

It is still another object of the invention to present a wire securing member having serrations with some wider angled walls than those heretofore, to allow them to fill with the wire conductor material more effectively during crimping.

It is still another object of the invention to present a wire securing member in which wire engaging serrations are employed which are tilted or angled toward the flow of wire to allow better conductor fill into the serrations and better insulation striping action from the wire.

It is still another object of the invention to present a wire securing member employing wire engaging serrations in which the serration ribs subjected to larger lateral forces are stronger than those to which no such lateral forces are applied.

It is still another object of the invention to present a wire securing member employing wire engaging serrations having narrow ribs to reduce the crimp force required and to allow the serrations to fill with wire material for more stable performance.

These and other objects, features and advantages will become apparent to those skilled in the art from the following detailed description when read in conjunction with the appended claims and the accompanying drawing.

The invention, in its broad aspect, presents a wire securing member for use in forming a structure such as a wire terminal connectable to external circuitry or a splice between two or more wires. The wire securing member includes an essentially rectangular metal surface adapted to be crimped about the wire or wires to form a securing barrel thereabout. A plurality of ridges of generally trapezoidal cross-sectional shape are arranged normal to an axis of the barrel to cut through the insulation layers of the wire or wires when the barrel is crimped thereon. The ridges make electrical contact to the conductors of the wires, and aid in securing the wire within the barrel. The spaces between each of the ridges are progressively shallower in depth in the direction away from one end of the barrel to promote contact between the metal of the surface and the conductor uniformly along the walls and bottom of the ridges. Also, the walls of the trapezoidal cross-sectional shape of each of the ridges progressively away from the one end of the barrel are of progressively increasing angle to provide increasing lateral strength to the ridges away from that one end. The angles of the walls of the other side of the ridges, however, are essentially all at the same angle. The varying angle can be between approximately 10° and approximately 30°, and the generally fixed angle can be of approximately 10°.

BRIEF DESCRIPTION OF THE DRAWING

The invention is illustrated in the accompanying drawing, wherein:

FIG. 1 is a perspective view of a typical wire to wire splice member, embodying the varying serrations, in accordance with the invention.

FIG. 2 is a perspective view, partially cut away, illustrating the splice member of FIG. 1 in a crimped position about and securing two wires.

FIG. 3 is a cross-sectional view, taken at 3—3 in FIG. 2 illustrating the varying serrations, in accordance with the invention.

Figure 4:
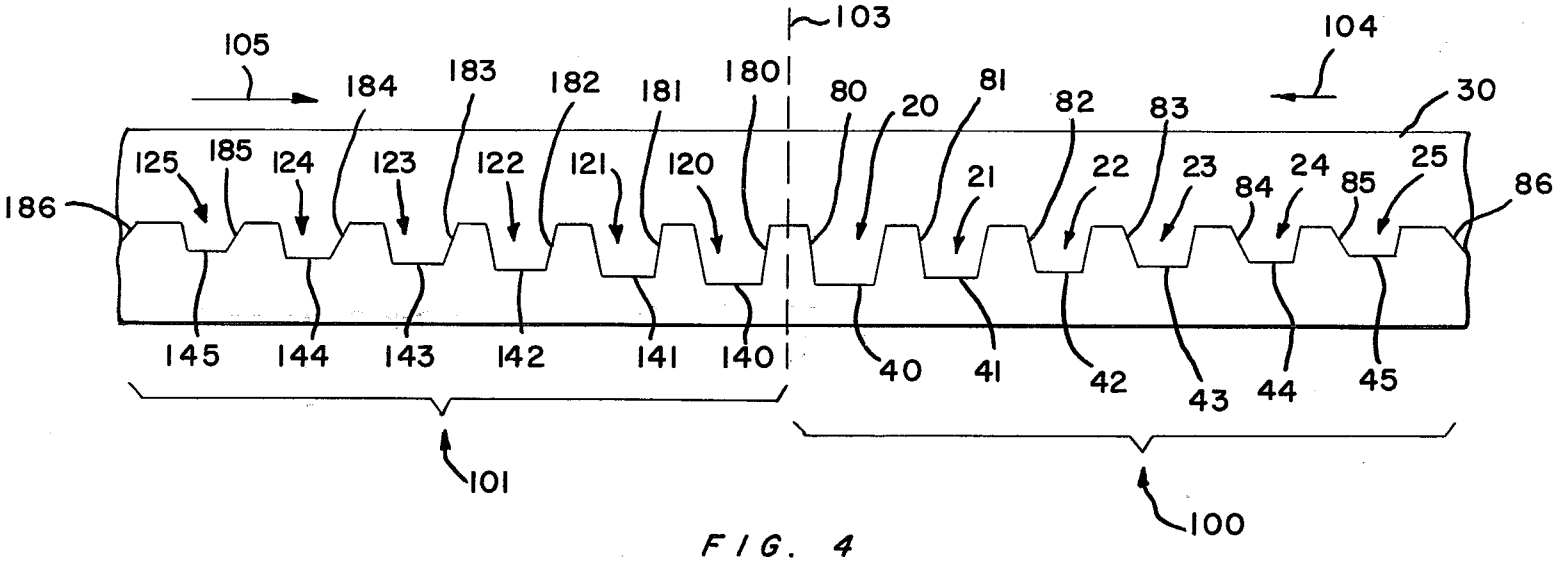
FIG. 4 is a sectional view of two sets of varying serrations of the type shown in FIG. 3 arranged back-to-back to provide opposing and cancelling lateral forces during crimping.

In the figures of the drawing, the sizes and dimensions of the parts have been exaggerated or distorted for ease of description and clarity of illustration.

Also, in the figures of the drawing, like reference numerals are used to denote like parts.

DETAILED DESCRIPTION OF THE PREFERRED EMBODIMENTS

With reference now to the drawing, FIG. 1 shows a typical splice member 10 prior to the insertion of the wires to be spliced therein. The splice member 10 is formed into a general "U" shape, defining an interior space or cavity 11 into which the wires to be spliced are placed. The walls 13 and 14 of the splice member 10 are formed continuously upon a base 16 to be generally upstanding, as shown, to be enabled to be crimped about the wires placed therebetween. Thus, the entire splice member 10, if flattened, would be essentially of rectangular shape in the form of a planar surface.

At one end of the splice member 10 is a tab or tongue 18, which is the remnant of a carrier member which interconnects adjacent terminals together during the manufacturing thereof.

A plurality of serrations of grooves 20 – 28 are formed on the interior face of the splice member 10 continuously along the walls 13 and 14 and across the bottom portion 16. The serrations are disposed so as to be aligned normal or perpendicular to an axis of a wire securing barrel formed by the walls 13 and 14 as below described. The serrations serve to cut through the insulation of the wires to be spliced within the interior 11, and to form physical and electrical connection thereto, as below described in detail.

As shown in FIG. 2, the splice member of FIG. 10 is formed by a crimping tool (not shown) to a general barrel form to surround a pair of wires 30 and 31. Thus, the wall 13 generally encircles the conductor 30 and the wall 14 surrounds the conductor 31, as shown. It should be noted that in the crimping process, the insulation of the wires 30 and 31 is essentially torn away from the conductors 30 and 31, and although scraps of the insulation material may remain in some area between the conductors 30 and 31 and the walls 13 and 14 of the splice member 10, the insulation scraps are not shown in the drawings for purposes of clarity.

The varying serrations of the splice member 10 along the bottom portion 16 are shown in FIG. 3. Ideally, the serrations are of progressively decreasing depth, or, put another way, are of progressively increasing shallowness from a fixed point at the left end of the splice member 10. The floor 40 of the serration 20 is deeper than the floor 41 of the adjacent serration 21, which, in turn, is deeper than the floor 42 of the adjacent serration 22, and so forth. The floor 45 of the last serration 28, is, as shown, shallowest of all.

As a practical matter the increasing shallowness of the grooves is done in groups of the serrations. For example, serrations 20 – 22 could all be of the same depth, serrations 23 – 25 could be shallower, but all of the same depth, and serrations 26 – 28 the shallowest, but also all of the same depth.

Thus, upon application of a crimping force to the splice member 10 and its enclosed wire 30, at the left most serration 20, a downward force will primarily be seen, as shown by the arrow 48. Since, however, the left end of the wire is blocked, for example, by a shearing or cutting blade (not shown) as the material of the wire 30 is compressed, an increasing lateral or horizontal component is seen upon the force applied to the conductor material 30. At the last serration 28, for example, a downward and rearward force is applied to the conductor material, as shown by the arrow 50. The angle of the force seen by the wire material 30 at the various serrations between serration 20 and serration 28 are at changing angular positions between the downward angle of the arrow 48 and the generally rightward angle of the arrow 50. Consequently, by virtue of the progressively decreasing floor depth, or depth of the serrations 20 – 28, the material of the wire 30 does not have to be forced downwardly into the serrations to the same extent at the right serration 28 as it does in the left serration 20. The lessening serrations' depth, therefore, produces better and more complete interface and better electrical connection between the material of the splice member 10 and the material of the wire 30 forced into the serrations.

As can be seen, the serrations are of generally trapezoidal shape, defining ridges 60 – 67 also of generally trapezoidal shape therebetween. The right wall of each of the serrations 20 – 28 (or the left wall of the ridges 60 – 67) are all of the same approximate angle. More specifically, the agle of the walls 70–78 are all approximately 10° from vertical. Although the angles shown are approximately 10°, this angle may vary, for example, between 8° and 15°.

On the other hand, the left most wall or the serrations 20–28 (or the right wall of the ridges 60–67) are of angle progressively increasing away from the left end of the splice member 10. Thus, the walls 80–88 increase from a vertical angle of approximately 10° at the serration 20 to an angle of approximately 30° at the serration 28. Again, the angles, because of the manner in which the serrations are formed, may vary somewhat from the 10° to 30° range as stated, for example, each angle being within plus or minus 5° from that intended.

Because of the increasing angular position of the walls 80–88, it can been that as the direction of force upon the wire 30 changes from vertical, shown by the arrow 48 at the serration 22 to diagonal, as shown by the arrow 50 at the serration 28, the easier it will be for the material of the wire 30 to flow into the contact the walls of the respective serrations therebeneath. Furthermore, since the angle of the walls 80–88 progressively increases to the right, the effective base width of the ridges 60–67 is increased, thereby increasing the strength of the ridges 60–67 progressively from left to right. The ridge strength is also increased by virtue of the diminished depth of the floors 40–45 of the serrations 20–28. The increased strength of the ridges 60–67, therefore, can withstand greater transverse forces progressively from the blocked end at the left in FIG. 3.

It should be noted that the serrations 20–28 can be formed in the splice member 10 by dragging a plurality of sharp pointed tools across the face thereof. This ordinarily results in the formation of barbs or ridges such as the ridges 90 and 91 upon the ridge 60. Although these barbs are a byproduct of the serration formation process, they serve a desirable function in assisting in cutting through the insulation of the wires to be secured within the splice member 10. The barbs also serve to establish point or line electrical connections with the conductor material 30.

As can be seen from the drawing in FIG. 3, because of the progressively decreasing floor depth of the serrations, and the progressively increasing angle of the adjacent ribs 60–67, the amount of conductor material 30 which flows into the respective serrations 20–28 can be optimized. Thus, the physical and electrical connection characteristics of the slice connection can be optimized as well. It should be noted that the particular desirable serration depth and angles may vary depending upon the sizes and materials used in the wires desired to be spliced or joined, but, such optimizing dimensions can be easily determined to suit the particular needs in each individual case.

It should also be emphasized, as mentioned above, that although the invention has been described in terms of a splice member 10, those skilled in the art will recognize that its principles are equally applicable to the fabrication of terminal type devices. In the fabrication of terminal type devices, however, ordinarily an end of the wire or wires to be included in the terminal connection are not blocked. Nevertheless, commonly used crimping tools produce an uneven or tapered crimping force upon the wire securing barrel forming portion of the terminal member. Because of this uneven force, a crimping force effect is produced in the wire causing increasing lateral forces to be applied therewithin. Thus, the same design considerations of varying serrations, as above described, with reference to FIG. 3, are equally applicable. The decreasing serration floor depth and increasing rear wall angle, of course, can be changed to accommodate the direction which the crimping tool squeezes the member and contained wires. It is also possible, in lieu of blocking by a shearing blade for example, to form two sets of serrations arranged back-to-back from a nominal dividing line, with each set having decreasing floor depths and increasing rear wall angles, as shown in FIG. 3, and referenced from said nominal dividing line. However, the two sets need not be mirror images. For example, one set can be of constant floor depths and rear wall angles, and the other set can be as shown in FIG. 3.

Also, in such instances, it may be desirable to decrease the depth of the deeper serrations, since there may not be as much material or conductor flow in a lateral direction due to the fact that there is no blocking at the end of the wires.

It can be seen that the different size and depth of the serrations permits a larger size of wire to be accommodated within the wire receiving barrel. If, for example, upon crimping, a wire of relatively small size is completely cut by one of the larger ridges, such as the ridge 60, it will, nevertheless, be properly secured by one of the smaller ridges to the right, such a ridges 61 – 67. Additionally, the conductor or wire material of different sized wires would make more efficient contact with the wire securing barrel, since a larger proportion of the conductor material is brought into contact with the walls and floors of the various serrations, thereby establishing good physical and electrical connection therebetween. This is significant in the case of different wire sizes, since regardless of whether a connection is made with the larger ridges (such as the ridges 60 – 62), a better connection is obtained by virtue of the shallower serrations than would otherwise be obtained.

Referring now to FIG. 4 there is shown a form of the invention employing two sets of varying serrations 100 and 101 extending in opposite directions from a common reference or dividing line 103. The group of varying serrations 100, which extend to the right from reference line 103, can be similar to the serrations of FIG. 3 with the parts thereof identified by the same reference characters. The second group of serrations 101 extend to the left from reference line 103.

As indicated above, the purpose of the second group of serrations 101 is to function as a counter force to those lateral forces produced by the serrations 100 during the crimping operation. More specifically, in the absence of blocking the crimping operation tends to cause the metal of wire 30 to flow in the direction of arrow 104 with respect to the serrations 100. By means of the second set of serrations 101 in a back-to-back relationship with serrations 100 a counter force in the direction of arrow 105 will be produced in wire 30 during crimping which will cancel the force generated in the direction of arrow 104, thereby resulting in the minimization of flow of the metal of wire 30 towards the reference line 103.

The second set of serrations 101, identified individually by reference characters 120 – 125, can be a mirror image of serrations 100 with the depth of the floors 140 – 145 decreasing successively with respect to dividing line 103 and with the angles of the rear walls 180 – 185 increasing successively when measured with respect to dividing line 103. Alternatively, since a primary purpose of the second set of serrations 101 is to provide a force counter to that produced by serrations 100, it is not necessary that the serrations 101 be a mirror image of serrations 100. The serrations 101 can have different rates of decreasing floor depth and also increasing rear wall angle than do the serrations 100. Such differences in decreasing floor depths and rear wall angles will result in some differences in the characteristics of the forces generated. However, the primary purpose of substantially cancelling the effect of the force generated by serrations 100 can be implemented effectively thereby.

Although the invention has been described and illustrated with a certain degree of particularity, it is understood that the present disclosure has been made only by way of example and that numerous changes in the details of construction and the combination and arrangement of parts may be resorted to without departing from the spirit and scope of the invention as hereinafter claimed.

WHAT IS CLAIMED IS:

1. A wire securing member for crimping about at least one wire, having a plurality of wire engaging serrations thereupon, comprising:

floors between adjacent serrations, each floor of progressively decreasing depth from the adjacent floor; and walls defining said serrations of progressively increasing angle in the direction which said floors become of decreasing depth, and of constant angle in another direction.

2. The terminal of claim wherein said progressively increasing angle increases from about 10° to about 30°, and wherein said constant angle is about 10°.

3. The terminal of claim 2 wherein said terminal further comprises circuitry connection means extending outwardly from said terminal.

4. A wire securing member for making connection to at least one wire, having a single piece of metal to be crimped about the wire to form a wire securing barrel, comprising:

a plurality of side-by-side ridges in the metal normal to an axis of the barrel, formed to penetrate an insulation layer on said wire, to contact an electrical conductor thereof, and to form an electrical connection thereto, upon crimping;

the interspacing between said ridges being of progressively decreasing depth to enhance the flow of the wire material uniformly into each thereof upon application of a crimping force; and the walls of said ridges in a direction opposite a fixed point being of progressively increasing slope to add increasingly greater strength to the successive ridges away from said fixed point and to promote a uniform wire receiving capability within said interspaces.

5. A wire securing member for connection to at least one wire, comprising:

an essentially rectangular metal surface adapted to be crimped about the at least one wire to form a securing barrel thereabout; and a plurality of ridges of generally trapezoidal cross-sectional shape, arranged normal to an axis of said barrel, to cut through an insulation layer upon said at least one wire to make electrical conduct to the conductor of said wire;

the spaces between each ridge being progressively shallower in the direction away from one end of said barrel to promote contact between the metal of the surface and the conductor of said at least one wire uniformly along the walls and bottom of said ridges;

the walls of the trapezoidal cross-sectional shape of each successive ridge referenced from said one end of said barrel and which face away from said one end of said barrel being of progressively increasing angle with respect to the axis of said barrel to provide increasing lateral strength to said ridges away from said one end of said barrel.

6. The wire securing member of claim 5 wherein said angles of said facing away walls increase from approximately 10° to approximately 30°.

7. The wire securing member of claim 6 wherein those walls of the trapezoidal cross-sectional shape of each of said ridges which face in the direction of said one end are all approximately the same angle.

8. The wire securing member of claim 7 wherein said approximate same angle is about 10° to 15°.

9. The wire securing member of claim 8 wherein said surface is adapted to be crimped about at least two wires to form a connection therebetween.

10. The wire securing member of claim 9 wherein said terminal further comprises circuitry connection means extending outwardly from said terminal.

11. The wire securing member of claim 5 wherein said rectangular metal surface forms a splice between at least two wires.

12. The wire securing member of claim 5 wherein said rectangular metal surface further comprises a circuitry connection member extending therefrom to form a wire terminal.

13. A wire securing member for crimping about at least one wire, having a plurality of groups of wire engaging serrations thereon comprising:

floors between adjacent serrations with the floors between the serrations of each group of serrations being of the same depth and with the floors of each group of serrations being of progressively decreasing depth relative to the floors of the adjacent group of serrations; and the walls defining each group of said serrations being of progressively increasing angle on the sides of said serrations facing the direction in which said floors become of decreasing depth.

14. The member of claim 1 wherein said progressively increasing angle increases from about 10° to about 30°, and wherein said constant angle is about 10°.

15. A wire securing member for connection to at least one wire, comprising:

an essentially rectangular metal surface adapted to be crimped about the at least one wire to form a securing barrel thereabout; and a plurality of groups of ridges of generally trapezoidal cross-sectional shape, arranged normal to an axis of said barrel, and constructed to cut throughh an insulation layer upon said at least one wire to make electrical contact with the conductor of said wire;

the spaces between the ridges of each group of ridges having substantially the same depth and shape, with the depth of the ridges of each succeeding group of ridges being progressively shallower from one end of said barrel to promote uniform contact between said metal surface and the conductor of said at least one wire along the walls and bottom of said ridges;

the first wall of the trapezoidal cross-sectional shape of each of the ridges facing away from said one end of said barrel being of progressively decreasing angle with respect to said axis of said barrel to provide increasing lateral strength to said ridges progressively removed from said one end.

16. The wire securing member of claim 15 wherein said angles of said first walls increase from approximately 10° to approximately 30°.

17. A wire securing member for making connection to at least one wire, having a single piece of metal to be crimped about the wire to form a wire securing barrel, comprising:

a plurality of groups of side-by-side ridges in the metal formed normal to the axis of the barrel, and constructed to penetrate through the insulation layer on said wire and to form an electrical connection therewith upon crimping;

the spacing between the said ridges of each group of ridges being of substantially the same depth but with said depth of each succeeding group of ridges becoming progressively shallower to enhance the flow of the wire material uniformly into each interspacing therebetween upon application of a crimping force; and the walls of said ridges on the side of said ridges facing the direction in which said interspacing becomes shallower being of progressively increasing slope to add increasingly greater strength to the succesive ridges in said first direction and to promote a uniform wire flow capability within the interspaces.

18. A wire securing member from crimping about at least one wire, having a first plurality of adjacent wire engaging serrations thereupon positions at increasing distances in a first direction from a nominal reference line, and comprising:

first floors between adjacent serrations, each floor of progressively decreasing depth from the adjacent floor in said first direction;

first wall defining said serrations of progressively increasing angle in the direction which said floors become of decreasing depth, and of constant angle in another direction; and a plurality of second wire engaging serrations adjacent said plurality of first wire engaging serrations and positioned at increasing distances in a second direction from said nominal reference line.

19. A wire securing member as in claim 18 in which said plurality of second wire engaging serrations comprise:

second floors between adjacent second wire engaging serrations;

each of said second floors being of progressively increasing depth from the adjacent second floor in said second direction; and second walls defining said serrations of progressively increasing angle in the direction in which said floors become of decreasing depth.

20. A wire securing member for crimping about at least one wire, having a plurality of groups of wire engaging serrations thereon comprising:

floors between adjacent serrations with the floors between the serrations of each group of serrations being of the same depth and with the floors of each group of serrations being of progressively decreasing depth relative to the floors of the adjacent group of serrations; and the walls defining each group of said serrations being of progressively increasing angle on the sides of said serrations facing the direction in which said floors become of decreasing depth.

* * * * *